US009991578B2

(12) United States Patent
Rogers

(10) Patent No.: US 9,991,578 B2
(45) Date of Patent: Jun. 5, 2018

(54) SYSTEMS AND METHODS FOR MODE SUPPRESSION IN A CAVITY

(71) Applicant: Honeywell International Inc., Morris Plains, NJ (US)

(72) Inventor: Shawn David Rogers, Johns Creek, GA (US)

(73) Assignee: Honeywell International Inc., Morris Plains, NJ (US)

( * ) Notice: Subject to any disclaimer, the term of this patent is extended or adjusted under 35 U.S.C. 154(b) by 199 days.

(21) Appl. No.: 14/918,416

(22) Filed: Oct. 20, 2015

(65) Prior Publication Data

US 2017/0110793 A1 Apr. 20, 2017

(51) Int. Cl.

| | |
|---|---|
| ***H01P 3/12*** | (2006.01) |
| ***H01P 1/22*** | (2006.01) |
| ***H01P 3/127*** | (2006.01) |
| ***H01Q 17/00*** | (2006.01) |
| ***H01P 7/06*** | (2006.01) |
| ***H01P 1/162*** | (2006.01) |

(52) U.S. Cl.

CPC ..... *H01P 3/127* (2013.01); *H01P 1/162* (2013.01); *H01P 3/12* (2013.01); *H01P 3/122* (2013.01); *H01P 7/06* (2013.01); *H01Q 17/00* (2013.01)

(58) Field of Classification Search

CPC ..... H01P 1/208; H01P 1/222; H01P 1/162; H01P 3/12; H01P 3/127

USPC ..... 333/208, 211

See application file for complete search history.

(56) References Cited

U.S. PATENT DOCUMENTS

| | | | | |
|---|---|---|---|---|
| 3,540,047 | A * | 11/1970 | Hach | H01F 10/14 342/1 |
| 4,201,987 | A | 5/1980 | Tricoles et al. | |
| 4,270,106 | A | 5/1981 | Woermbke | |
| 5,949,298 | A * | 9/1999 | Ives | H01P 1/262 333/22 F |
| 6,023,203 | A * | 2/2000 | Parish | H01P 5/12 324/628 |
| 6,441,771 | B1 * | 8/2002 | Victora | H01Q 17/002 342/1 |
| 6,727,781 | B2 * | 4/2004 | Saito | H05K 9/0056 333/12 |
| 2003/0190498 | A1 * | 10/2003 | Fujieda | H01L 23/552 428/8 |
| 2007/0188397 | A1 | 8/2007 | Parsche | |

(Continued)

OTHER PUBLICATIONS

Dixon, Paul. "Dampening cavity resonance using absorber material", Microwave Technology, May 2004, pp. 16-19.

(Continued)

*Primary Examiner* — Rakesh Patel
(74) *Attorney, Agent, or Firm* — Fogg & Powers LLC

(57) ABSTRACT

Systems and methods for mode suppression in a cavity are provided. In certain implementations, an apparatus comprises a cavity for propagating electromagnetic signals therein, wherein the electromagnetic signals propagate multiple times through the cavity; and an absorbing material applied to a first side of the cavity, wherein the absorbing material absorbs the electromagnetic signals. Further, an apparatus includes at least one transmitting antenna configured to couple electromagnetic energy into the cavity; and at least one receiving antenna configured to couple electromagnetic energy from the cavity.

18 Claims, 4 Drawing Sheets

(56) References Cited

U.S. PATENT DOCUMENTS

| | | | | |
|---|---|---|---|---|
| 2011/0102286 | A1* | 5/2011 | Gualtieri | H01Q 7/00 343/817 |
| 2012/0244815 | A1 | 9/2012 | Altan et al. | |
| 2013/0143483 | A1* | 6/2013 | Gore | H04B 7/15585 455/7 |
| 2013/0234806 | A1* | 9/2013 | Schmidhammer | H01P 1/213 333/133 |

OTHER PUBLICATIONS

Dixon, "Theory and Application of RF/Microwave Absorbers", Apr. 2012, pp. 1-19, Publisher: Emerson & Cunning Microwave Products, Published in: US.

* cited by examiner

SYSTEMS AND METHODS FOR MODE SUPPRESSION IN A CAVITY

STATEMENT REGARDING FEDERALLY SPONSORED RESEARCH OR DEVELOPMENT

This invention was made with Government support under USAF AFRL/RV. The Government has certain rights in this invention.

BACKGROUND

Electromagnetic waves are able to propagate through a waveguide cavity formed between parallel plates. In certain implementations, when a wave propagates multiple times within a cavity, multiple paths are created such that the multiple paths for wave propagation overlap. When the wave paths overlap, the multiple waves constructively and destructively interfere with each other causing peaks and nulls within the signal. When a receiver receives the signal within the cavity, the nulls may cause signal dropouts that reduce the reliability of a communication link. For example, in a digital communication system the signal dropouts cause errors that increase the bit error rate above a desired threshold.

SUMMARY

Systems and methods for mode suppression in a cavity are provided. In certain implementations, an apparatus comprises a cavity for propagating electromagnetic signals therein, wherein the electromagnetic signals propagate multiple times through the cavity; and an absorbing material applied to a first side of the cavity, wherein the absorbing material absorbs the electromagnetic signals. Further, an apparatus includes at least one transmitting antenna configured to couple electromagnetic energy into the cavity; and at least one receiving antenna configured to couple electromagnetic energy from the cavity.

DRAWINGS

Understanding that the drawings depict only exemplary embodiments and are not therefore to be considered limiting in scope, the exemplary embodiments will be described with additional specificity and detail through the use of the accompanying drawings, in which.

Figure 1:
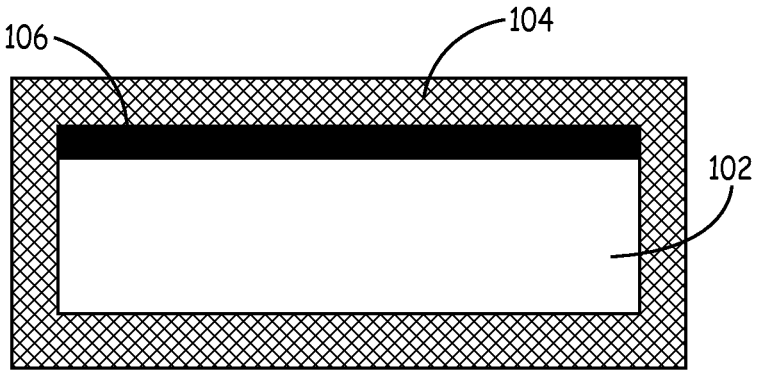
FIG. 1 is a cross sectional diagram of a cavity containing absorbing material in one embodiment described in the present disclosure.

In accordance with common practice, the various described features are not drawn to scale but are drawn to emphasize specific features relevant to the exemplary embodiments.

DETAILED DESCRIPTION

In the following detailed description, reference is made to the accompanying drawings that form a part hereof, and in which is shown by way of illustration specific illustrative embodiments. However, it is to be understood that other embodiments may be utilized and that logical, mechanical, and electrical changes may be made. Furthermore, the method presented in the drawing figures and the specification is not to be construed as limiting the order in which the individual steps may be performed. The following detailed description is, therefore, not to be taken in a limiting sense.

Embodiments described herein provide systems and methods for suppressing modes within a waveguide cavity. To suppress modes within a waveguide cavity, an absorbing material is attached to an interior surface of the waveguide cavity. The absorbing material within the waveguide cavity may dampen the internal resonances of the cavity, causing the waveguide to attenuate signals as they propagate through the waveguide cavity. As a side effect the absorbing material reduces the average transmit power appearing at the receive antenna. To overcome the loss of transmit power, a receiver is designed to have a dynamic range that overcomes the additional loss of average transmit power.

FIG. 1 is a diagram of a cavity 102 in which electromagnetic waves propagate, where a surface 104 of the cavity 102 is coated with an electromagnetic absorbing material 106. As understood by one having skill in the art, the dimensions of the cavity 102 determine the electromagnetic modes that exist and influence the signal transmission between a transmitting antenna and a receive antenna located within the cavity 102. In certain implementations, the electromagnetic waves can propagate within the cavity 102 such that the signals are reflected by the edge walls of the cavity 102 and thus propagate in multiple directions or paths across the cavity 102. Hence, the names "multipath propagation" or "multipath" is given to these phenomena. When signals are reflected multiple times through the cavity 102, there is the potential for multiple time-delayed copies of the same signal to add constructively and destructively. The constructive and deconstructive interference results in both peaks and nulls that may make it difficult to recover a transmitted signal by a receiver in the cavity 102. For example, the interference may cause a receiver to experience either significant bit errors, signal dropouts, or both errors and dropouts.

To reduce the presence of these so-called multipath effects, a surface 104 of the cavity 102 may be coated with absorbing material 106. The absorbing material 106 absorbs signals that propagate within the cavity 102. In certain implementations, the absorbing material 106 may be made from a silicon rubber that has been infused with magnetic particles. The signal absorbing material 106 may be flexible and non-conductive, while having a high electric permittivity and high magnetic permeability. The placing of the absorbing material 106 on a surface 104 of the cavity 102 allows the absorbing material to reduce the peaks and nulls within the cavity 102. In particular, the absorbing material 106 dampens the internal resonances of the cavity, thus attenuating the signal as it propagates through the cavity 102. By attenuating the signal as it propagates through the cavity 102, multipath effects caused by the multiple reflections are significantly reduced. As such a signal may be introduced into the cavity 102 by a transmitter and be received by a receiver in the cavity 102 with less susceptibility to nulls and peaks that may negatively affect the reception of the signal.

In certain implementations, the absorbing material is designed to absorb a broad range of modes. Alternatively, the absorber may be designed to absorb a narrow range of frequencies. In at least one implementation, the absorbing material 106 may be loaded with a magnetic material such as an iron or ferrite that has a high permittivity and permeability plus a high magnetic loss. The magnetic material within the absorbing material 106 absorbs the electromagnetic energy within the cavity 102. In certain exemplary embodiments, the absorbing material 106 may have a thickness between 3% and 7% of the width of the cavity 102. Other absorbing material 106 thicknesses are also possible. In some implementations, the absorbing material 106 is placed on only a portion of a surface of the cavity, such that there are voids in the absorbing material 106 along at least one surface in the cavity. Alternatively, absorbing material 106 may also be fabricated from dielectric material. The absorbing material 106, when composed of dielectric material, may be made of a polyurethane foam material loaded with a lossy dielectric or resistive material such as carbon. When the absorbing material 106 is composed of dielectric material the thickness of the absorbing material 106 may be thicker to provide the same effect as the absorbing material 106 composed of magnetic material. Absorbing material 106 may be made from other types of material.

Figure 2:
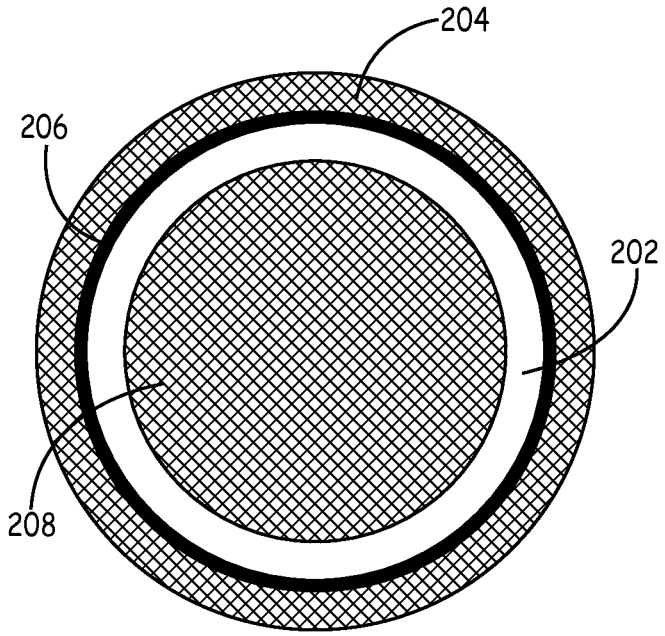
FIG. 2 is a cross sectional diagram of a spherical cavity containing absorbing material in one embodiment described in the present disclosure.

FIG. 2 is a diagram of a spherical cavity 202 having absorbing material 206 applied to a surface 204 of the spherical cavity 202. As illustrated, in FIG. 2, the spherical cavity encloses an inner sphere 208. In certain implementations, electromagnetic waves may be introduced into the spherical cavity 202 to be received by a receiving antenna within the cavity, where the receiving antenna is located at a different location from the location where electromagnetic waves are introduced. Absent the absorbing material 206, electromagnetic energy introduced into the cavity 202 may propagate multiple revolutions through the cavity 202. At the receiving antenna, the electromagnetic signal has propagated multiple revolutions and from multiple directions through the cavity 202 such that there are potentially peaks and nulls due to multipath effects caused by the multiple revolutions around the inner sphere 208.

Figure 3A:
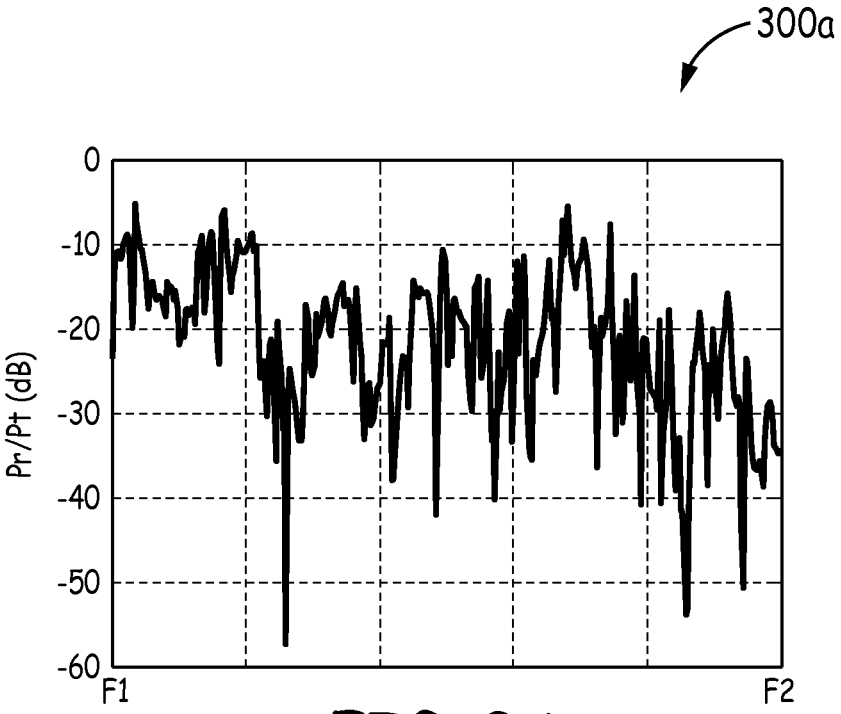
FIG. 3A is an illustration of a graph of received power divided by transmitted power from a cavity lacking absorbing material in one embodiment described in the present disclosure.
Figure 3B:
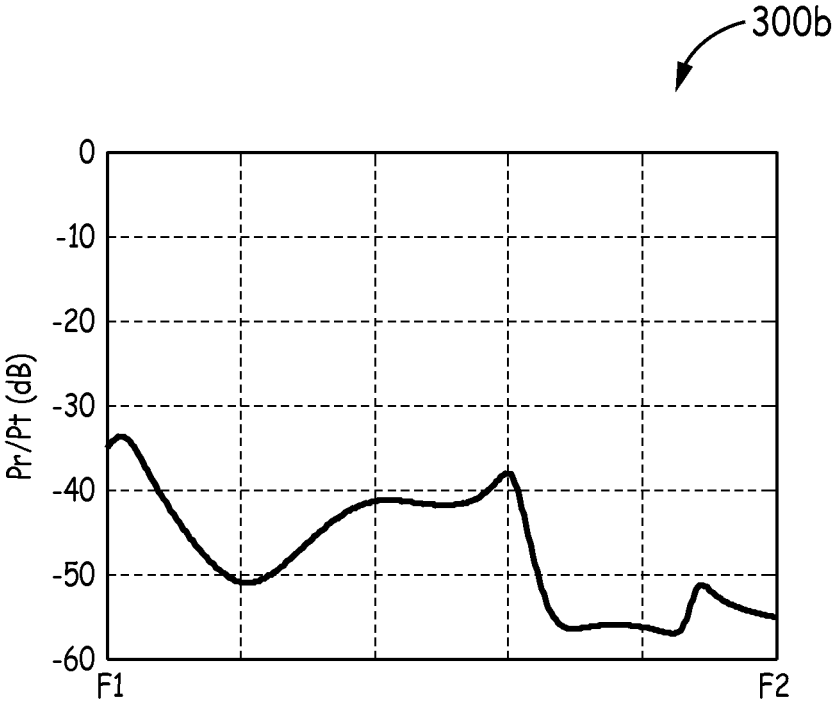
FIG. 3B is an illustration of a graph of received power divided by transmitted power from a cavity having absorbing material in one embodiment described in the present disclosure.

In order to reduce the multipath effects, the absorbing material 206 is placed on a surface of the cavity 202 to absorb the propagation of the signal within the cavity 202. As such, when a signal is introduced into the cavity 202, the signal may be significantly attenuated by being absorbed by the absorbing material 206 before the signal fully propagates around the inner sphere 208. Due to the attenuation, peaks and nulls from the multipath effects are significantly removed. For example, FIG. 3A represents a graph 300*a* of received signal power relative to the transmitted power at a receiving antenna in a cavity lacking the absorbing material 206 and FIG. 3B represents a graph 300*b* of received signal power relative to the transmitted power at a receiving antenna in a cavity having an absorbing material 206 placed on a surface 204. Comparing FIG. 3B to FIG. 3A shows the effect of the absorbing material 206. As shown, graph 300*a* in FIG. 3A has a signal that has many peaks and nulls as the signal appears to be noisy due to the deconstructive and constructive interference caused by multipath effects of the signal within the spherical cavity. In contrast, graph 300*b* in FIG. 3B is not noisy as the absorbing material 206 has absorbed the multipath signals. However, the ratio of the received power to the transmitted power is markedly less as the signal is attenuated by the absorbing material 206. Accordingly, the receiving system may be designed to receive the lower received signal power caused by the absorption of the transmitted signal by the absorbing material 206.

Figure 4:
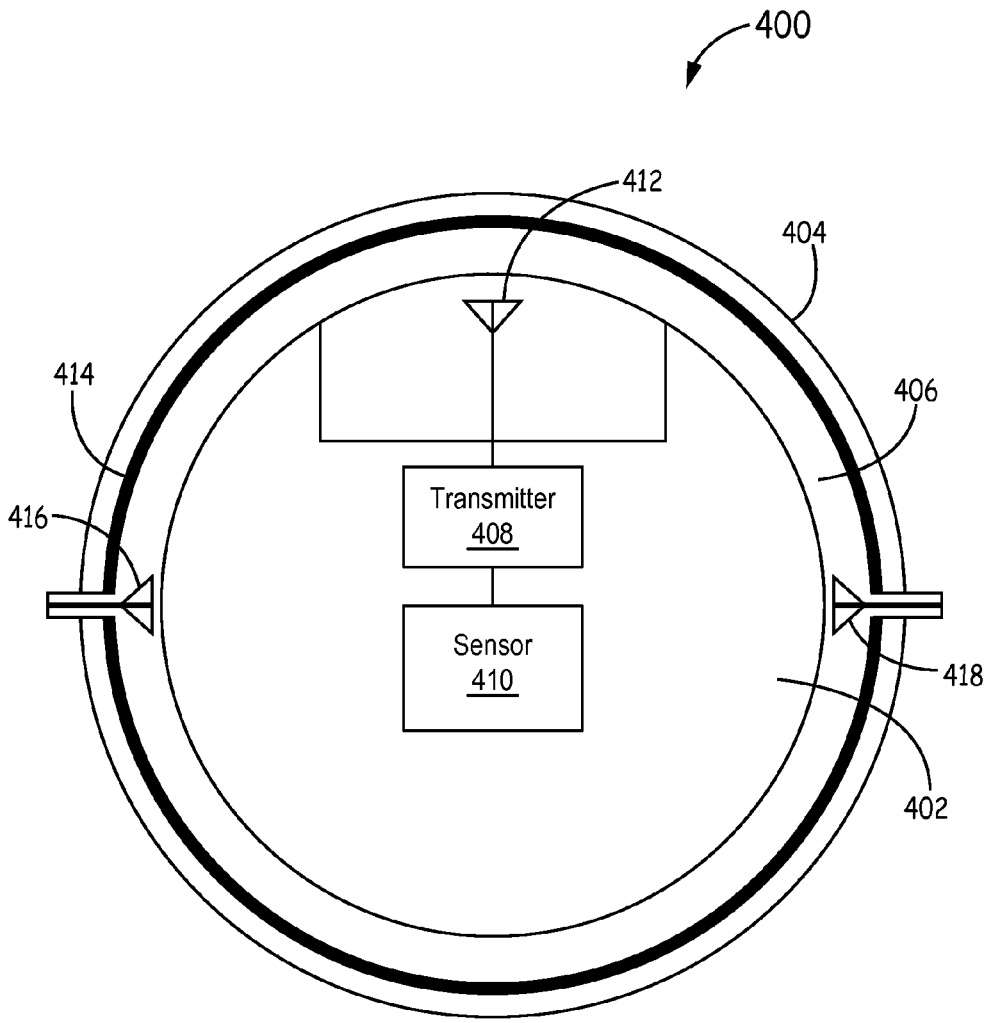
FIG. 4 is a diagram of a system that communicates through the transmission of an electromagnetic signal through a spherical cavity in one embodiment described in the present disclosure.

FIG. 4 is a diagram of one implementation for a spherical waveguide. In particular, FIG. 4 is a diagram of an exemplary embodiment of a sensor unit 400. The sensor unit 400 has a spherical cavity 406 through which a data signal is transmitted between antennas. In particular, the sensor unit 400 includes an inner sphere 402 and an outer shell 404. The outer shell 404, in this embodiment, is also spherical. However, it is to be understood that the outer shell 404 can also be implemented with other configurations. For example, the outer shell 404 can be implemented with a square outer surface and a spherical inner surface that forms the spherical cavity 406 into which the inner sphere 402 is deposited. The inner sphere 402 is suspended inside the outer shell 404 such that the outer surface of the inner sphere 402 does not contact the inner surface of the outer shell 404. Thus, the inner sphere 404 is capable of rotating in any direction.

In the exemplary embodiment of FIG. 4, the inner sphere 402 includes a sensor 410 and a transmitter 408. In this example, the sensor 410 may be implemented as a health monitoring sensor which monitors the status of the components located in the inner sphere 402. Sensor 410 may also be other sensor types.

The sensor 410 provides data to the transmitter 408 for transmission through the spherical cavity 406. The transmitter 408 controls the modulation of a signal radiated from a transmit antenna 412. In at least one exemplary implementation, the antenna 412 conforms to the spherical surface of the inner sphere 404.

Also located inside the spherical cavity 406 are receive antennas 416 and 418. For example, in some embodiments, the receive antenna 416 is located at an opposite side of the sphere from the location of receive antenna 418. Alternatively, the receive antennas 416 and 418 may be located at any position within the outer shell 404, for example, the receive antennas 416 may be in a position that is orthogonal to the position of the receive antenna 418. In at least one implementation, the receive antennas 416 and 418 may be monopole antennas that extend into the spherical cavity 406.

As described above, due to the spherical cavity 406 and movement of the inner sphere 402 in the spherical cavity 406, each of receive antennas 416 and 418 may receive multiple versions of the same signal, each version travelling a different path. The multipath signals received at each antenna 416 and 418 can cause increased noise or interference in the signal received. However, to decrease the signal strength of the multipath signals, absorbing material 414 is applied to the interior surface of the outer shell 404. Alternatively, the absorbing material 414 may be applied to the exterior surface of the inner sphere as long as the absorbing material 414 does not significantly interfere with the operation of the transmitting antenna 412. As described above the absorbing material 414 attenuates the signal such that the effects of multipath signals on the transmitted signal are negligible at the receive antennas 416 or 418.

In at least one embodiment, to apply the absorbing material 414, before assembly of the outer shell 404, the outer shell 404 may exist as two separate halves or hemispheres. A liquid material may be applied to the interior surfaces of the two hemispheres and then allowed to cure to form a conformal elastomeric layer as the absorbing material 414. When the absorbing material 414 is cured and other necessary components are in place, the outer shell 404 may be assembled around the inner sphere 402.

In certain implementations, as the absorbing material 414 attenuates the signals that propagate within the spherical cavity 406, the receive antennas 416 and 418 may be designed to receive signals at reduced reception power. Even though the primary transmitted signal is attenuated by the absorbing material 414, the multipath signals are substantially more attenuated such that their effects become negligible.

Figure 5:
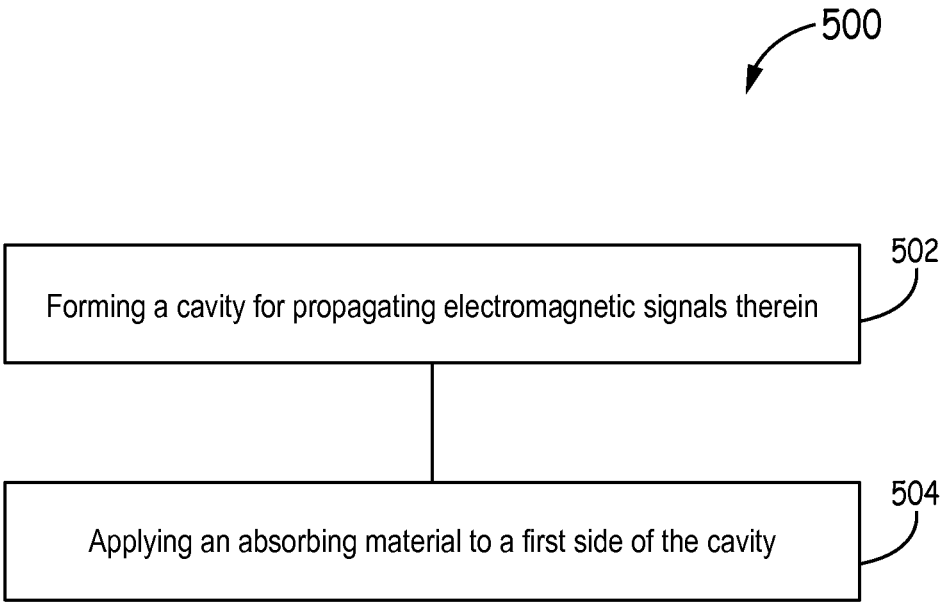
FIG. 5 is a flow diagram of a method for constructing a cavity having a layer of absorbing material in one embodiment described in the present disclosure.

FIG. 5 is a flow diagram of a method 500 for fabricating a cavity having an absorptive material therein. For example, method 500 proceeds at 502 where a cavity is formed for propagating electromagnetic signals therein. Further, method 500 proceeds at 504, where an absorbing material is applied to a first side of the cavity. For example, the cavity may be formed from an outer shell having a first part and a second part, wherein the first part of the outer shell and the second part of the outer shell both have an interior surface, wherein the absorbing material is applied to the interior surface. Further, an inner sphere may be formed and placed within either the first part or the second part of the outer shell. Then the first part of the outer shell is joined to the second part of the outer shell to enclose the inner sphere. Accordingly, a spherical cavity may be formed between the interior surfaces of the outer shell and the surface of the inner sphere.

EXAMPLE EMBODIMENTS

Example 1 includes an apparatus, the apparatus comprising: a cavity for propagating electromagnetic signals therein, wherein the electromagnetic signals propagate multiple times through the cavity; and an absorbing material applied to a first side of the cavity, wherein the absorbing material absorbs the electromagnetic signals.

Example 2 includes the apparatus of Example 1, further comprising: at least one transmitting antenna configured to couple electromagnetic energy into the cavity; and at least one receiving antenna configured to couple electromagnetic energy from the cavity.

Example 3 includes the apparatus of Example 2, wherein the receiving antenna is coupled to a receiver located outside of the cavity.

Example 4 includes the apparatus of Example 3, wherein the receiver is configured to receive signals at a low reception power.

Example 5 includes the apparatus of any of Examples 1-4, wherein the cavity is a spherical cavity formed between a spherical interior surface of an outer shell and a spherical exterior surface of an inner sphere.

Example 6 includes the apparatus of Example 5, wherein the absorbing material coats the spherical interior surface.

Example 7 includes the apparatus of any of Examples 5-6, wherein the inner sphere encloses a sensor, a transmitter, and a transmitting antenna, the transmitting antenna coupling signals from the transmitter into the spherical cavity for reception by at least one receiving antenna.

Example 8 includes the apparatus of any of Examples 1-7, wherein the absorbing material has voids which leave portions of the first side of the cavity uncovered.

Example 9 includes the apparatus of any of Examples 1-8, wherein the absorbing material is fabricated from silicon infused with magnetic particles.

Example 10 includes an apparatus, the apparatus comprising: a cavity for propagating electromagnetic signals therein, wherein the electromagnetic signals propagate multiple times through the cavity; an absorbing material applied to a first side of the cavity, wherein the absorbing material absorbs the electromagnetic signals; at least one transmitting antenna configured to couple electromagnetic energy into the cavity; and at least one receiving antenna configured to couple electromagnetic energy from the cavity.

Example 11 includes the apparatus of Example 10, wherein the receiving antenna is coupled to a receiver located outside of the cavity.

Example 12 includes the apparatus of Example 11, wherein the receiver is configured to receive signals at a low reception power.

Example 13 includes the apparatus of any of Examples 10-12, wherein the cavity is a spherical cavity formed between a spherical interior surface of an outer shell and a spherical exterior surface of an inner sphere.

Example 14 includes the apparatus of Example 13, wherein the absorbing material coats the spherical interior surface.

Example 15 includes the apparatus of any of Examples 13-14, wherein the inner sphere encloses a sensor and a transmitter, the at least one transmitting antenna coupling signals from the transmitter into the spherical cavity for reception by at least one receiving antenna.

Example 16 includes the apparatus of any of Examples 10-15, wherein the absorbing material has voids which leave portions of the first side of the cavity uncovered.

Example 17 includes the apparatus of any of Examples 10-16, wherein the absorbing material is fabricated from silicon infused with magnetic particles.

Example 18 includes a method for fabricating a waveguide cavity, the method comprising: forming a cavity for propagating electromagnetic signals therein, wherein the electromagnetic signals propagate multiple times through the cavity; and applying an absorbing material to a first side of the cavity, wherein the absorbing material absorbs the electromagnetic signals as the electromagnetic signals propagate through the cavity.

Example 19 includes the method of 18, wherein forming the cavity comprises: fabricating an inner sphere; fabricating a first part of an outer shell; fabricating a second part of an outer shell, wherein the first part of the outer shell and the second part of the outer shell both have an interior surface, wherein the absorbing material is applied to the interior surface; placing the inner sphere within the first part of the outer shell; joining the second part of the outer shell to the first part of the outer shell such that the interior surfaces of the first part of the outer shell and the second part of the outer shell form a spherical surface enclosing the inner sphere.

Example 20 includes the method of 19, further comprising: at least one transmitting antenna located in the inner sphere configured to couple electromagnetic energy into the cavity; and at least one receiving antenna configured to couple electromagnetic energy from the cavity to a receiver outside the cavity.

Although specific embodiments have been illustrated and described herein, it will be appreciated by those of ordinary skill in the art that any arrangement, which is calculated to achieve the same purpose, may be substituted for the specific embodiments shown. Therefore, it is manifestly intended that this invention be limited only by the claims and the equivalents thereof.

What is claimed is:

1. An apparatus, the apparatus comprising:

a cavity for propagating electromagnetic signals therein, wherein the electromagnetic signals propagate multiple times through the cavity; and an absorbing material applied to a first side of the cavity, wherein the absorbing material absorbs the electromagnetic signals;

at least one transmitting antenna configured to couple electromagnetic energy into the cavity; and at least one receiving antenna configured to couple electromagnetic energy from the cavity;

wherein the cavity encompasses the at least one transmitting antenna and the at least one receiving antenna; and wherein the cavity is formed between an interior surface of an outer shell and an exterior surface of an inner sphere.

2. The apparatus of claim 1, wherein the absorbing material is fabricated from silicon infused with magnetic particles.

3. The apparatus of claim 1, wherein the at least one receiving antenna is coupled to a receiver located outside of the cavity.

4. The apparatus of claim 3, wherein the receiver is configured to receive signals at a low reception power.

5. The apparatus of claim 1, wherein the cavity is a spherical cavity, the interior surface is a spherical interior surface, and the exterior surface is a spherical exterior surface.

6. The apparatus of claim 5, wherein the absorbing material coats the spherical interior surface.

7. The apparatus of claim 5, wherein the inner sphere encloses a sensor, a transmitter, and the at least one transmitting antenna, the at least one transmitting antenna coupling signals from the transmitter into the spherical cavity for reception by the at least one receiving antenna.

8. The apparatus of claim 1, wherein the absorbing material has voids which leave portions of the first side of the cavity uncovered.

9. An apparatus, the apparatus comprising:

a spherical cavity for propagating electromagnetic signals therein, wherein the electromagnetic signals propagate multiple times through the cavity;

an absorbing material applied to a first side of the cavity, wherein the absorbing material absorbs the electromagnetic signals;

at least one transmitting antenna configured to couple electromagnetic energy into the spherical cavity;

at least one receiving antenna configured to couple electromagnetic energy from the spherical cavity;

wherein the spherical cavity encompasses the at least one transmitting antenna and the at least one receiving antenna; and wherein the spherical cavity is formed between a spherical interior surface of an outer shell and a spherical exterior surface of an inner sphere.

10. The apparatus of claim 9, wherein the absorbing material is fabricated from silicon infused with magnetic particles.

11. The apparatus of claim 9, wherein the at least one receiving antenna is coupled to a receiver located outside of the cavity.

12. The apparatus of claim 11, wherein the receiver is configured to receive signals at a low reception power.

13. The apparatus of claim 9, wherein the absorbing material has voids which leave portions of the first side of the cavity uncovered.

14. The apparatus of claim 9, wherein the absorbing material coats the spherical interior surface.

15. The apparatus of claim 9, wherein the inner sphere encloses a sensor and a transmitter, the at least one transmitting antenna coupling signals from the transmitter into the spherical cavity for reception by the at least one receiving antenna.

16. A method for fabricating a waveguide cavity, the method comprising:

forming a cavity for propagating electromagnetic signals therein, wherein the electromagnetic signals propagate multiple times through the cavity by:

fabricating an inner sphere;

fabricating a first part of an outer shell;

fabricating a second part of the outer shell, wherein the first part of the outer shell and the second part of the outer shell both have an interior surface;

placing the inner sphere within the first part of the outer shell;

joining the second part of the outer shell to the first part of the outer shell such that the interior surfaces of the first part of the outer shell and the second part of the outer shell form a spherical surface enclosing the inner sphere;

applying an absorbing material to a first side of the cavity, wherein the absorbing material absorbs the electromagnetic signals as the electromagnetic signals propagate through the cavity; and wherein the cavity further encompasses at least one transmitting antenna and at least one receiving antenna.

17. The method of claim 16, wherein applying the absorbing material to the first side of the cavity further comprises applying the absorbing material to the interior surface of the first part and the interior surface of the second part of the outer shell.

18. The method of claim 17, wherein:

the at least one transmitting antenna is located in the inner sphere is configured to couple electromagnetic energy into the cavity; and the at least one receiving antenna is configured to couple the electromagnetic energy from the cavity to a receiver outside the cavity.

* * * * *